US006476366B2

(12) United States Patent
Lipperts

(10) Patent No.: US 6,476,366 B2
(45) Date of Patent: Nov. 5, 2002

(54) DEVICE FOR DEGASSING AND BRAZING PREASSEMBLED VACUUM INTERRUPTERS USING INDUCTIVE HEATING

(75) Inventor: Jerrie Lipperts, Venlo (NL)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/839,984

(22) Filed: Apr. 18, 2001

(65) Prior Publication Data

US 2002/0014472 A1 Feb. 7, 2002

(30) Foreign Application Priority Data

Apr. 18, 2000 (DE) ..... 100 19 070

(51) Int. Cl.[7] ..... H05B 6/10

(52) U.S. Cl. ..... 219/615; 219/634; 219/635; 219/651; 219/655; 219/676

(58) Field of Search ..... 219/615, 616, 219/634, 635, 647, 651, 672, 674, 676, 655, 656; 218/118, 134, 136

(56) References Cited

U.S. PATENT DOCUMENTS 2,747,066 A * 5/1956 Brace ..... 219/615
2,784,285 A * 3/1957 Brauer et al. ..... 219/615
2,876,324 A * 3/1959 Longacre ..... 219/615
3,045,093 A * 7/1962 Morgan et al. ..... 219/615
3,659,552 A * 5/1972 Briody ..... 219/634
4,197,957 A * 4/1980 Buhrer ..... 220/2.1 R
5,753,876 A * 5/1998 Lanning ..... 218/134

* cited by examiner

*Primary Examiner*—Philip H. Leung
(74) *Attorney, Agent, or Firm*—Davidson, Davidson & Kappel, LLC

(57) ABSTRACT

A device for degassing and brazing preassembled vacuum interrupters in only one brazing operation includes a base plate having at least one brazing site which features an opening of the base plate for connecting a suction pump and a bell which covers the opening and can be put on the base plate and lifted off. The bell is surrounded on the outside by an excitation coil to which medium- or high-frequency energy can be applied. The device includes a medium- or high-frequency generator for the excitation coil and with a cylindrical tubular susceptor arranged inside the bell for receiving at least one preassembled vacuum interrupter.

20 Claims, 7 Drawing Sheets

DEVICE FOR DEGASSING AND BRAZING PREASSEMBLED VACUUM INTERRUPTERS USING INDUCTIVE HEATING

FIELD OF THE INVENTION

The present invention relates to a device for degassing and brazing preassembled vacuum interrupters in one brazing operation.

RELATED TECHNOLOGY

Vacuum interrupters for vacuum circuit breakers, vacuum contactors, vacuum load interrupters in the medium-voltage range and also in the low-voltage range, for example, as motor protection switch, have a variety of uses.

The structure of a typical vacuum interrupter is depicted in the drawing in FIG. 2. Vacuum interrupter 1 includes movable conductor 12 and stationary conductor 13 which are equipped with a contact piece at the front-side ends facing each other. The actual vacuum tube is formed by metallic cover parts 15 including an insulator 14 located therebetween. Movable conductor 12 is sealed with respect to the cover by a bellows 16. The outer parts forming the vacuum tube are interconnected via brazing points L, just as contact pieces 18, 19 with conductors 12, 13. The contact pieces are laterally surrounded by cylindrical screen 17 which is also fixedly connected to cover 15 via a brazing point.

The oldest method for manufacturing the vacuum interrupter, namely the degassing, welding, and brazing of the parts, is the so-called "pinch-off method". In this context, the parts made of high-grade steel are initially pre-degassed at approximately 1,000° C., then the stationary contact group and the movable contact group are each pre-brazed individually, and the complete vacuum interrupter is assembled of these parts and coupled to an ultra-high vacuum pump system via a copper pipe, and subsequently heated to a temperature of 400° to 500° C. during at least 24 hours, cooled down, and the copper pipe is squeezed together, i.e., pinched off via a hydraulic pressing device. Then, the vacuum interrupter is separated from the ultra-high vacuum pump system.

Another known method for manufacturing vacuum interrupter is described as direct brazing sealing technique. In this case, the high-grade steel parts are equally pre-degassed at approximately 1,000° C., and the stationary contact subassembly and the movable contact subassembly are pre-brazed between 700° C. and 960° C. Subsequently, the brazed subassemblies, together with the appropriate ceramic bodies and corresponding brazing foils, are preassembled to form the vacuum interrupter, pumped empty at temperatures between 700° C. to 860° C., degassed, the getter is activated, and the vacuum interrupter is sealed ultra-high vacuum tight inside a high-vacuum brazing furnace. The aforesaid manufacturing techniques are multi-step methods.

Moreover, the "one-shot brazing" technique is known, in which all brazing and degassing operations for manufacturing the vacuum interrupter are carried out in an integrated manner in only one brazing cycle.

For carrying out the direct brazing sealing technique and the one-shot brazing technique, special high-vacuum brazing furnaces are required which can reach a final pressure between $5\times10^{-7}$ and $5\times10^{-8}$ mbar in the cold condition. These high-vacuum brazing furnaces have the feature of being composed of a double-walled cylinder which is closed with a double walled dished head on both ends. One of the dished heads is designed as a door so that the furnace can be loaded and unloaded. The furnace contains heating elements made of graphite, molybdenum or tungsten. If molybdenum and tungsten heating elements are used, the furnace is provided with a metallic lining made of molybdenum and/or high-grade steel. Depending on the size of the useful space of the furnace and on the geometry of the vacuum interrupters to be manufactured, it is possible for 50 to 500 vacuum interrupters to be brazed and degassed in one batch. Such a brazing cycle is composed of:

1. Evacuating furnace and batch to $5\times10^{-4}$ to $5\times10^{-5}$ mbar in 45 to 80 minutes.
2. Switching on the heating and carrying out a predetermined temperature program for furnace and charge until the brazing temperature is reached:
   letting furnace and charge cool off
   switching on the rapid cooling and waiting until approximately 40 to 70° C. are reached.

Depending on the batch, a complete brazing cycle takes approximately 10 to 12 hours and is always a discontinuous process, involving the three working steps of loading the furnace, brazing the batch, and unloading the furnace.

SUMMARY OF THE INVENTION

An object of the present invention is to provide a faster and more inexpensive method for degassing and brazing vacuum interrupters based on the one-shot brazing technique, in particular, to reduce the outlay of energy and time.

The present invention provides a device for degassing and brazing preassembled vacuum interrupters in only one brazing operation, including a base plate (21) having at least one brazing site (2) which features an opening (27) of the base plate for connecting a suction pump and a bell (20) which covers the opening (27) and can be put on the base plate and lifted off, and including an excitation coil (3) which surrounds the bell (20) on the outside and to which medium- or high-frequency energy can be applied, including a medium- or high-frequency generator for the excitation coil, and a susceptor (4) which is arranged inside the bell (20) and designed as a cylindrical tubular piece for receiving at least one preassembled vacuum interrupter.

As a holding device for the vacuum interrupters, a grid-like locating plate for inserting the preassembled vacuum interrupters is preferably provided in the opening of the base plate or on the base plate above the opening. Depending on the size of the vacuum interrupter and of the grid, possibly, several smaller vacuum interrupters can be arranged in lieu of a large vacuum interrupter. The grid-like structure of the locating plate brings about a high flow conductance during the pumping out of the gases.

To attain a high vacuum, moreover, it is proposed for an annular groove to be formed on the upper side of the base plate, the annular groove surrounding the opening, and a suitable sealing ring being arranged therein in a manner that it is joined to the base plate in a high vacuum-tight manner.

For exact heating to attain the brazing temperature and for cooling, provision is made for thermoelements which are arranged in the head region of the bell via a high vacuum-tight gland. Also provided are pressure-measuring elements for the inside space and for the suction line to the suction pump, i.e., an ultra-high vacuum pump system for achieving the appropriate degassing and the corresponding high vacuum with certainty.

For this, preferably, suction connecting pieces which are fixedly connected or which can be connected in a vacuum-tight manner are provided on the bottom side of the base plate at the opening.

The fast heating via the excitation coil and the allocated susceptor which is made of a material which very easily absorbs magnetic field lines and is able to very quickly absorb magnetic energy is essential to the invention. The susceptor is preferably composed of soft magnetic materials, such as iron and iron alloys, for example, Fe, FeNi, FeNiCo, etc. This applies especially in the lower frequency spectrum. In the higher range of the used frequency spectrum, it is also possible to use higher-melting metals and alloys, such as Mo (molybdenum), W (tungsten), Ta (tantalum), high-grade steels and superalloys. Using the medium- or high-frequency energy according to the present invention, the object to be brazed, i.e., the preassembled vacuum interrupter, can be very quickly heated to the desired brazing temperature.

The arrangement may be such that the excitation coil has an annular design and surrounds the bell, namely transversely to the vertical switching axis of the vacuum interrupter which is appropriately arranged inside the bell, the excitation coil being arranged approximately centrically with respect to the susceptor surrounding the vacuum interrupter. For an optimum heating, provision is made for the susceptor to be arranged on insulating supports in a manner that it is spaced from the base plate so that it surrounds the regions of the vacuum interrupter which are to be brazed.

The powers which can be delivered by the excitation coil can vary between 1.2 kW to approximately 30 kW, the frequencies lying between 3.5 kHz and approximately 1 MHz.

An ultra-high vacuum pump is used as the suction pump so that the pressure inside the bell can be kept at a value smaller than $2\times10^{-7}$ during the entire brazing process.

The bell is movable, in particular raisable, for example, with the assistance of a lifting device, for the loading and unloading of the brazing device.

For increased productivity, it is preferred for the base plate to be equipped with more than one brazing site, i.e., with more than one opening, each opening being allocated a bell on the upper side and suction connecting piece on the bottom side. All suction connecting pieces of a base plate are led to a high vacuum system via suction lines, and each suction connecting piece is allocated a corresponding high vacuum valve for coupling and/or separating the bell to the high vacuum pump. The heating device in the form of the excitation coil with the generator is allocated to the brazing sites such that the individual brazing sites can be approached successively by the one excitation coil by moving the excitation coil and the generator correspondingly. In the case that two rows of brazing sites are provided on the base plate parallel to each other, the excitation coil with the generator can be arranged on a rail located therebetween in a manner that they are traversable and rotatable and raisable. If the brazing sites are arranged in a circle on a disk, the excitation coil with the generator can be arranged in the center and be moved to the individual brazing sites by a corresponding rotary movement. Moreover, the generator can be equipped with a lifting device for performing a vertical lifting movement.

Furthermore, it is possible for the manufacturing installation containing several brazing sites and a generator and an excitation coil to be equipped with a control device so that the manufacturing process can be carried out automatically, that is the loading of the brazing sites, the evacuation of the loaded brazing sites, the heating, cooling and the removal and the reloading, which can take place successively just as on a carousel. The control can be performed via computer, for example personal computer (PC), and/or with the assistance of a programmable control system.

The device according to the present invention makes it possible for vacuum interrupters to be manufactured in an economical manner. In this context, the following advantages are achieved:

- Very fast heating of the vacuum interrupters through the use of small units, i.e., small bells as vacuum chambers.
- Good possibilities of monitoring the preassembled vacuum interrupter during the entire brazing process through the use of transparent quartz glass bells; each vacuum interrupter can be monitored visually as well.
- The flow of the brazing material during the brazing process of the vacuum interrupter can be easily monitored.

By designing each brazing site for one or more vacuum interrupters with the smallest possible space requirement, extremely short evacuation times for the brazing site underneath the bell are possible.

Due to the small volume and mass of the brazing device and because of the only small number of vacuum interrupters to be brazed at a brazing site, it is possible to attain very low pressures during the brazing process.

The entire device for degassing and brazing vacuum interrupters altogether requires low investment cost because of the simple design, however, it being possible to manufacture large manufacturing quantities of vacuum interrupters in an automated or semi-automated process in the installation.

Very fast heating and cooling times of the brazing site in the bell are possible because only one or only a small number of vacuum interrupters need to be heated or cooled at one brazing site.

It is possible to measure the temperature and also the pressure in the chamber very exactly and to control the manufacturing process accordingly.

The device according to the present invention is suitable, in particular, for manufacturing vacuum interrupters for load interrupter switches, vacuum contactors for medium and low voltage.

BRIEF DESCRIPTION OF THE DRAWINGS

In the following, the present invention will be elaborated upon with reference to the drawings.

DETAILED DESCRIPTION

Figure 1A:
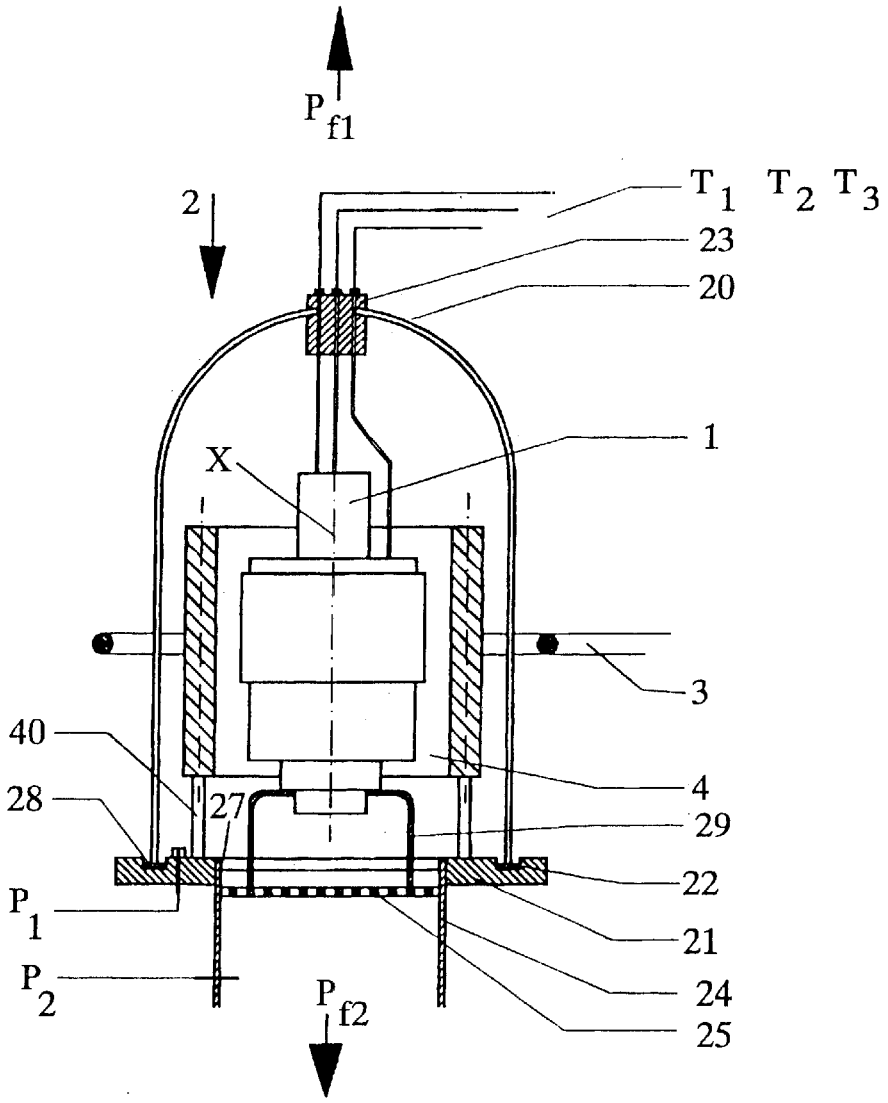
FIGS. 1*a*, 1*b*, 1*c* show vertical cross-sectional views of a brazing device having one brazing site in the conditions closed, open and empty, respectively, as well as open and loaded with a vacuum interrupter.
Figure 1B:
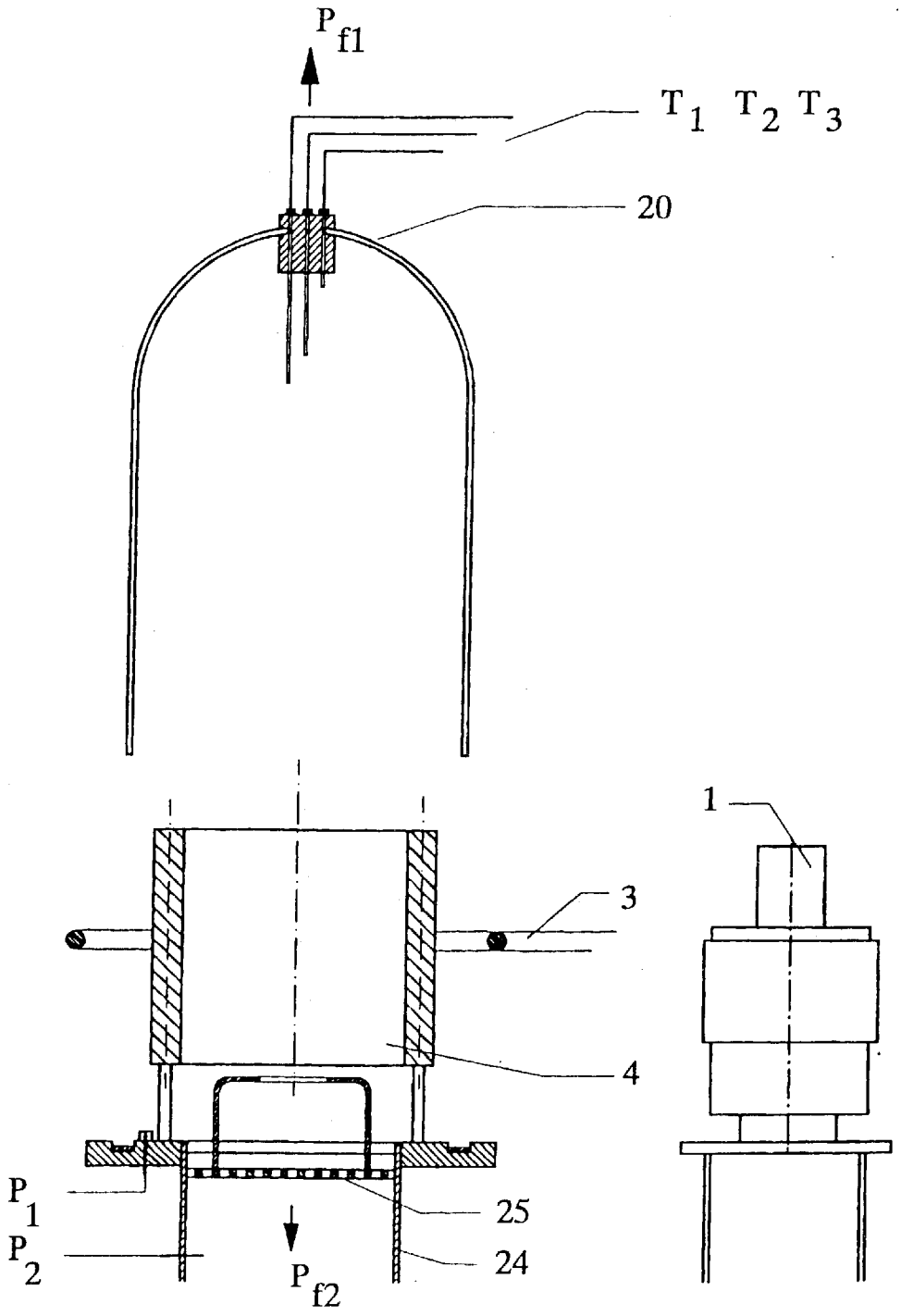
Figure 1C:
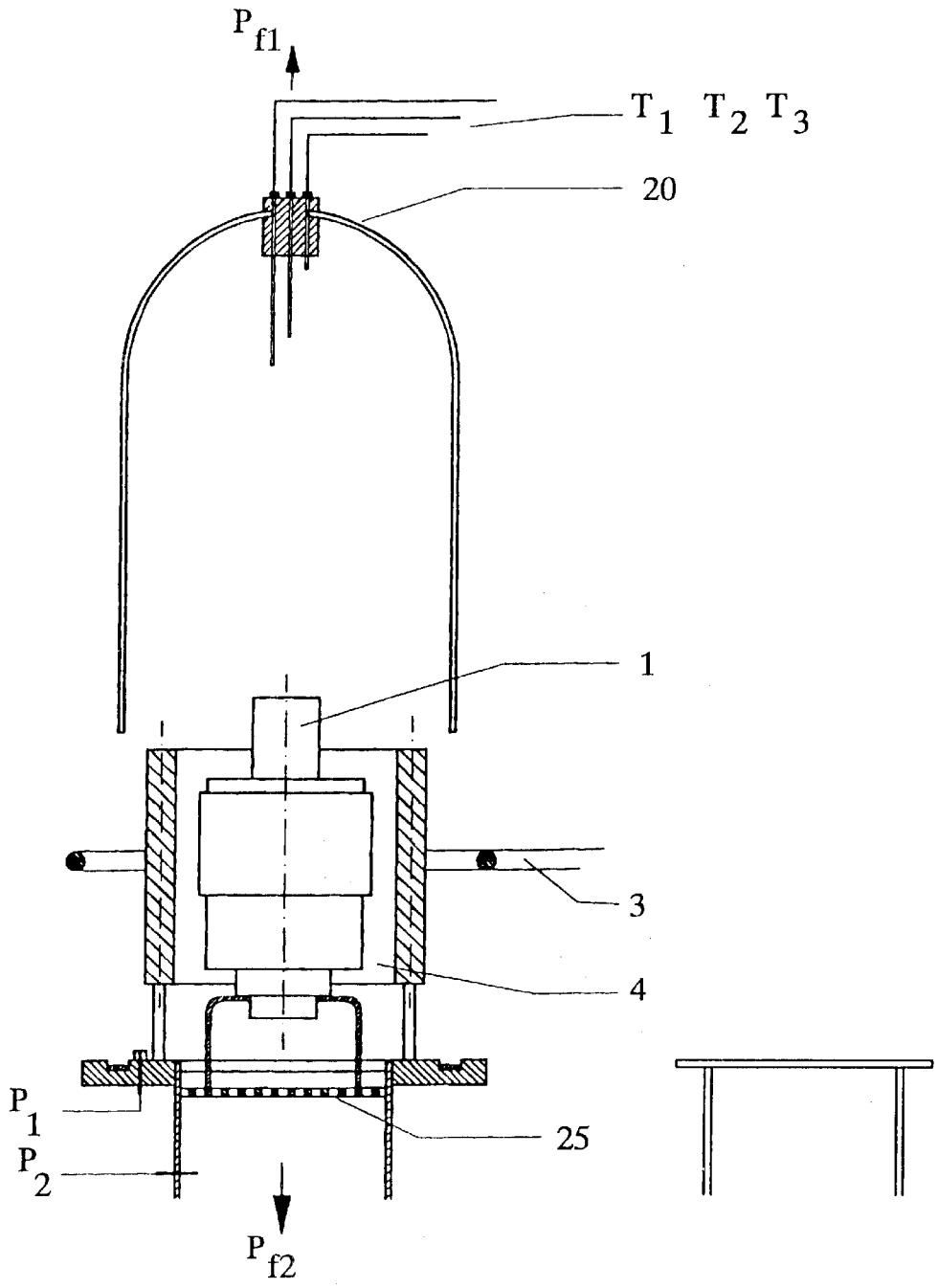
Figure 2:
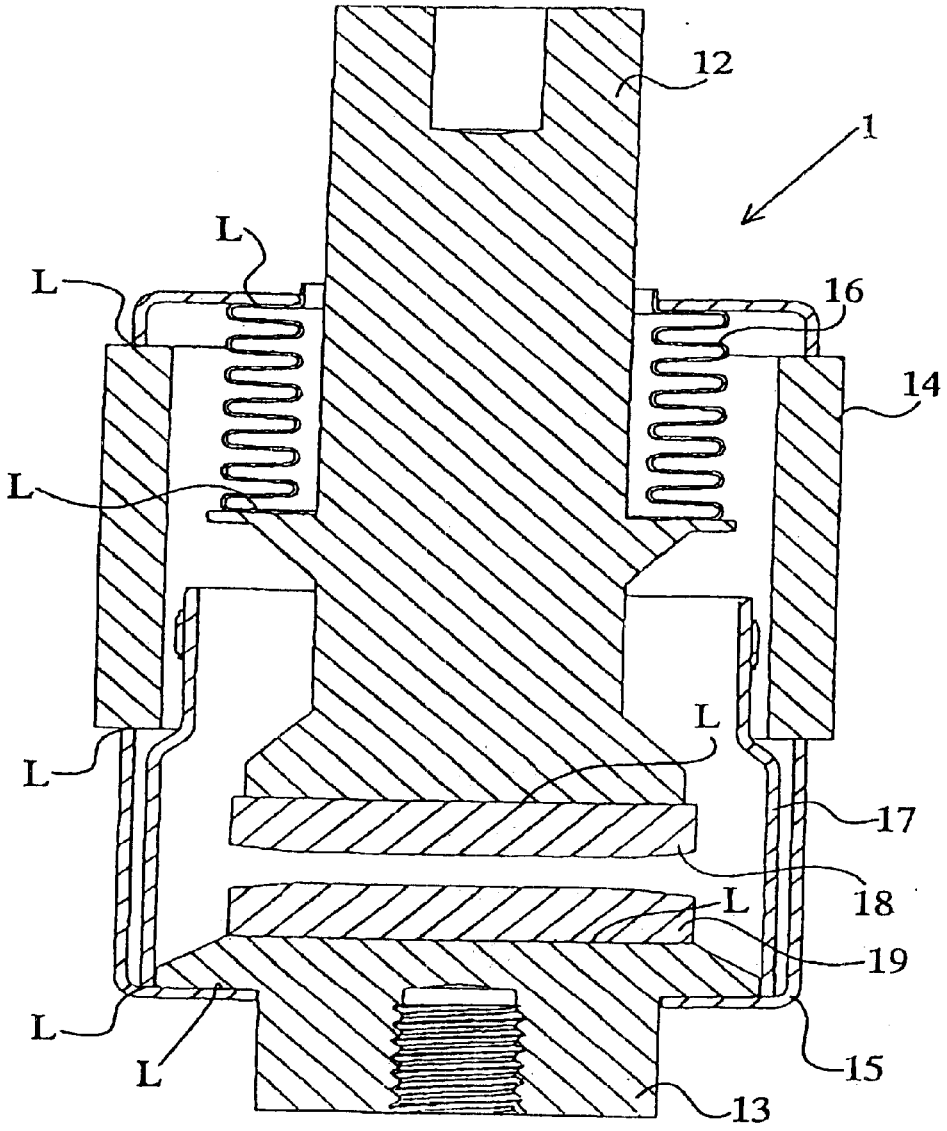
Prior Art Fig. 2
FIG. 2 shows a vertical cross-sectional view of a prior art preassembled vacuum interrupter.

The structure of a prior art vacuum interrupter for medium and low voltage is depicted in FIG. 2. For concurrently brazing and degassing the preassembled vacuum interrupter and completion thereof, provision is made for a device having the basic design according to FIGS. 1*a*, 1*b*, 1*c*. A brazing site 2 for at least one or a small number of preassembled vacuum interrupters 1 is set up on base plate 21 made of high-grade steel. An opening 27 having, for example, a circular form is allocated to brazing site 2 on base plate 21. On the upper side of the base plate, an annular groove 28 is formed around opening 27, a sealing ring 22, for example a Viton O-ring, being arranged therein in a manner that it is joined to base plate 21 in a high vacuum-tight manner. Bell 20 made of quartz glass is put on base plate 21 and sealing ring 22. On the bottom side of base plate 21, suction connecting piece 24 is connected to opening 27 in a high vacuum-tight manner, the suction connecting piece being connected to an ultra-high vacuum pump system which is not further show here. In the head region of bell 20, provision is made for a high vacuum-tight gland 23 for thermoelements T1, T2, T3, or even more, for measuring the temperatures inside the glass bell during the manufacturing process in different regions. For holding preassembled vacuum interrupter 1 to be brazed and degassed, a locating plate 25, preferably a grid-like locating plate 25, or a perforated plate is attached to the base plate, preferably in the region of opening 27. A supporting frame 29 for the vacuum interrupter is secured to locating plate 25. The preassembled vacuum interrupter can be held in a brazing jig with which it is held at the brazing site in the locating plate or in the supporting frame in switching axis X of the vacuum interrupter in a self-centering manner by insertion. Locating plate 25 has a grid-like design to permit a connection having a high flow conductance between bell 20 and suction connecting piece 24. Pressure-measuring elements P1 and P2 are installed in bell 20 and suction line 24, respectively, for measuring the pressure during the manufacturing process and for ensuring the required high vacuum via the pump system.

To quickly achieve a sufficient brazing temperature, provision is made for excitation coil 3, which annularly surrounds bell 20 on the outside transversely to vacuum interrupter 1 which is supported vertically in switching axis X. Excitation coil 3 is operated using medium- or high-frequency energy, for which provision is made for a medium-frequency generator or high-frequency generator which is not further shown. To achieve a homogenous heating and a homogenous temperature of vacuum interrupter 1 which is to be brazed and which is located inside brazing site 2, a susceptor 4 is placed inside bell 20 between excitation coil 3 and vacuum interrupter 1. Susceptor 4 has the cylindrical shape of a tubular piece and is arranged on the upper side of base plate 21 on insulating supports 40 in a spaced manner. The length of susceptor 4 is dimensioned such that it externally covers the regions of vacuum interrupter 1 which are to be brazed. The susceptor can be composed of a material which very easily absorbs magnetic field lines and is consequently able to very quickly absorb magnetic energy, for example, of soft magnetic materials, such as iron and iron alloys. By applying the medium- or high-frequency energy via excitation coil 3, the vacuum interrupter to be brazed can be very quickly heated to the desired brazing temperature.

The manufacturing process may be executed as follows: Bell 20 is raised in the direction of arrow Pf1, see FIG. 1*b*; preassembled vacuum interrupter 1, which is preassembled in a brazing jig, is inserted from its waiting position into locating plate 25 of the brazing site, see FIG. 1*c*; bell 20 is put onto the base plate again, see FIG. 1*a*; then bell 20 is evacuated to a value smaller than $2\times10^{-7}$ via the pump system connected via suction connecting piece 24. Then, vacuum interrupter 1 is heated by applying medium-frequency energy to excitation coil 3, it being possible for the power of the coil to lie between 1.2 kW to 30 kW, depending on the object to be brazed, frequencies between 3.5 kHz and 1 MHz being preferred. The temperature inside bell 20 and at vacuum interrupter 1 is measured via thermoelements T1, T2, T3 . . . through Tn, and the heating time up to the brazing temperature, the brazing process, and the subsequent cooling are controlled via a process control (not shown). The temperatures required for brazing the vacuum interrupter may lie between 700° C. and 960° C. Subsequent to brazing and already during cooling, bell 20 is flooded with very pure and dry nitrogen up to atmospheric pressure and raised again in the direction of arrow Pf1, and the degassed and brazed vacuum interrupter 1 is removed, and a new preassembled vacuum interrupter including brazing jig is inserted again.

Figure 8:
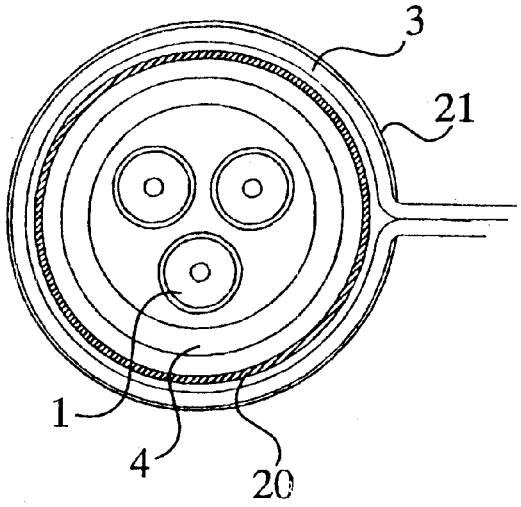
FIG. 8 shows a top view schematic of the device shown in FIG. 7.
Figure 7:
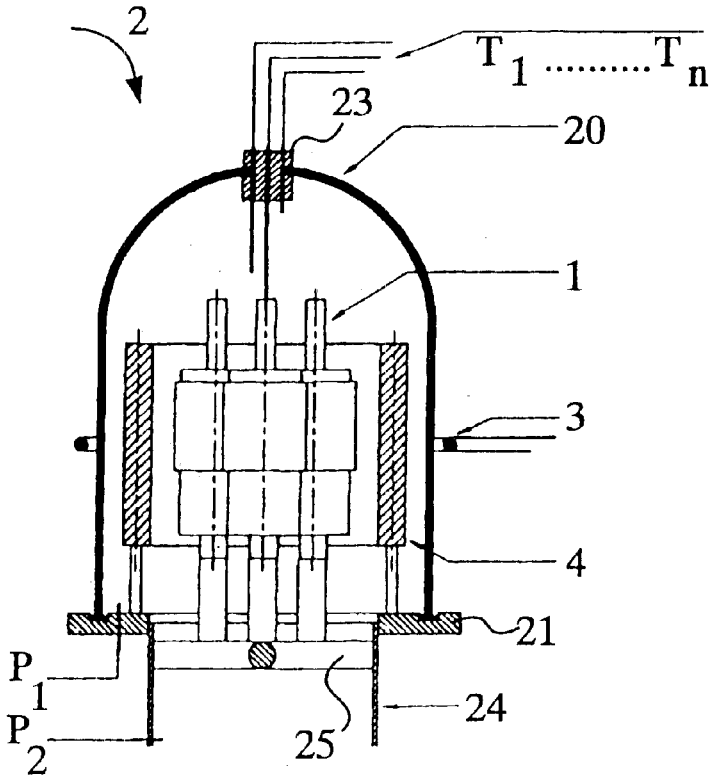
FIG. 7 shows a vertical cross-sectional schematic view of a brazing site for several vacuum interrupters.

In the case that the intention is for smaller vacuum interrupters 1 to be degassed and brazed, it is also possible, for example, for 3 preassembled vacuum interrupters 1 to be inserted in locating plate 25 at a brazing site 2, as depicted in FIGS. 7 and 8, and to carry out the degassing and brazing process as described in connection with FIG. 1.

Figure 3:
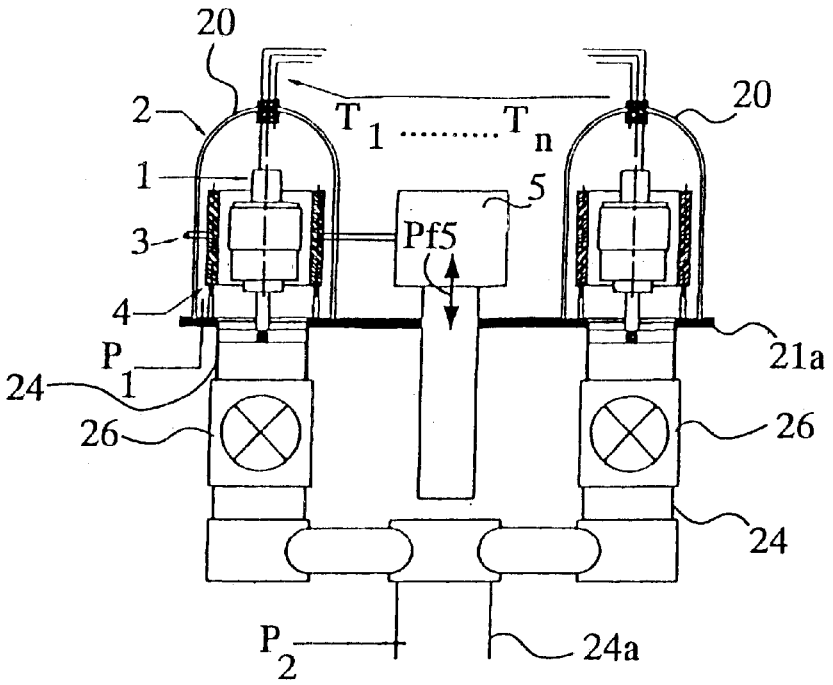
FIG. 3 shows a side cross-sectional schematic view of a device having two brazing sites arranged parallel.
Figure 4:
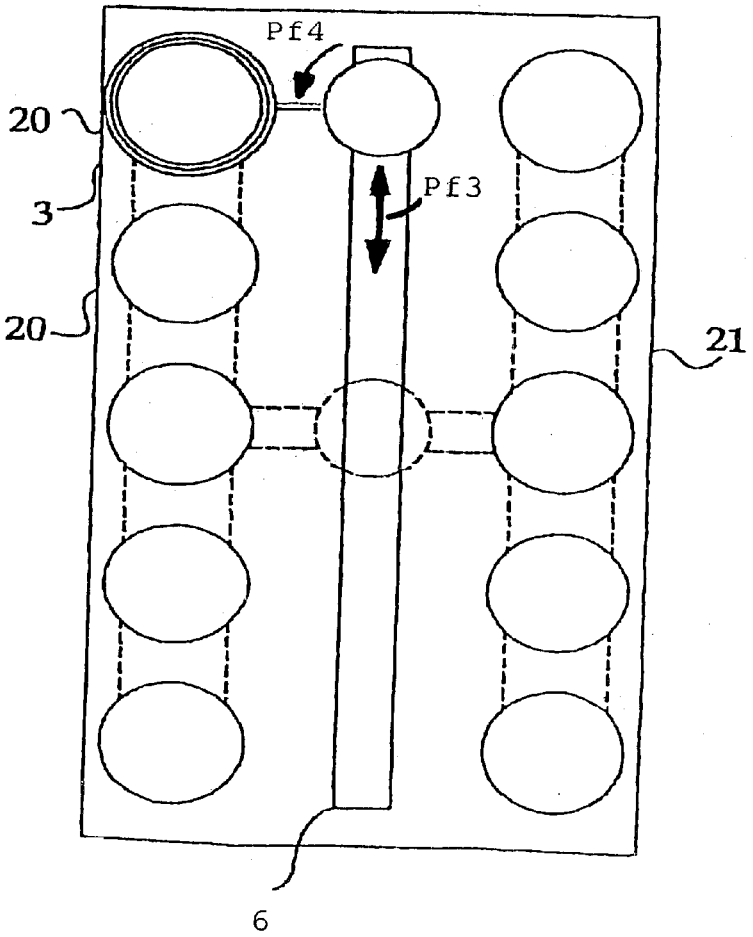
FIG. 4 shows a top schematic view of the device shown in FIG. 3.

The device according to the present invention having a brazing site for a vacuum interrupter can advantageously be multiplied; for example, a plurality of brazing sited being configured on a base plate 21, an example of which is schematically shown in FIGS. 3 and 4. For example, brazing sites 2 can be arranged on base plate 21 in two rows which are parallel to each other, each brazing site having an opening 27, and being equipped with a susceptor 4 and a bell 20 containing thermoelements on the upper side of base plate 21, and suction connecting piece 24 for the connection to the high vacuum pump system being provided on the bottom side of base plate 21. All suction connecting pieces 24 of each brazing site 2 are equipped with a high vacuum valve 26 for coupling and/or separating bell 20 to the high vacuum pump, the suction connecting pieces being connected to the high vacuum pump system via a further connecting side 24*a*. For the heating of the brazing site or of the vacuum interrupter, generator 5 with excitation coil 3 is arranged on a rail 6 in a manner that it is traversable in the direction of arrow Pf3, the rail being arranged parallel between the two rows of brazing sites. Moreover, generator 5 with excitation coil 3 is arranged on rail 6 in a manner that it is rotatable about its vertical axis in the direction of arrow Pf4 so that generator 5 including excitation coil 3 can approach each brazing site of each row at random and/or in succession via a movement in the direction of arrows Pf3 or Pf4, respectively.

The manufacturing process is carried out in such a manner that, while bell 20 is lifted off, both the loading and de unloading of brazing site 2 with vacuum interrupter 1 is carried out and excitation coil 3 is moved into position or removed from the position, and, subsequent to loading and positioning the excitation coil, bell 20 is put on brazing site 20 again. For the positioning of excitation coil 3, moreover, provision is made for a lifting device for moving the generator including the excitation coil in the direction of arrow Pf5. Using the device depicted in FIGS. 3 and 4, it is possible for the individual brazing sites 2 to be activated in succession and/or at random, permitting great flexibility during the loading, brazing, unloading, and cooling of the vacuum interrupters to be brazed. Because of the design of the traversable and movable excitation coil 3, the advantage is achieved that the overall investment with respect to the vacuum systems and the medium-frequency or high-frequency generator can be kept low. Moreover, the installation containing several brazing sites requires only one ultra-high vacuum pump system for evacuating the individual bells 20 in succession and/or at random, respectively. To this end, only one high vacuum valve 26 is required between each bell and the pump system, enabling each bell including its contents to be used autonomously.

Figure 5:
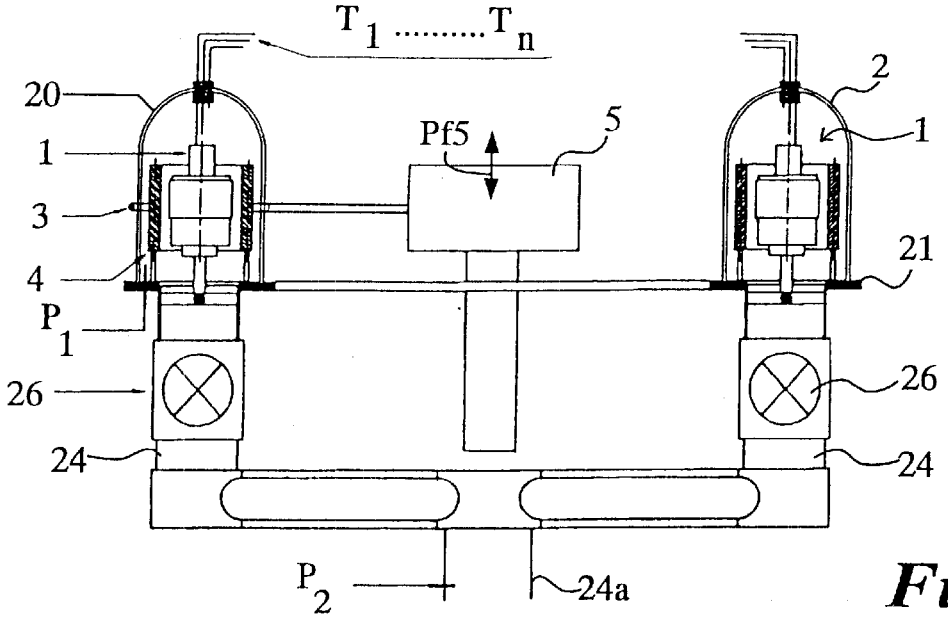
FIG. 5 shows a vertical cross-sectional schematic view of a device having brazing sites which are arranged on a circular ring.
Figure 6:
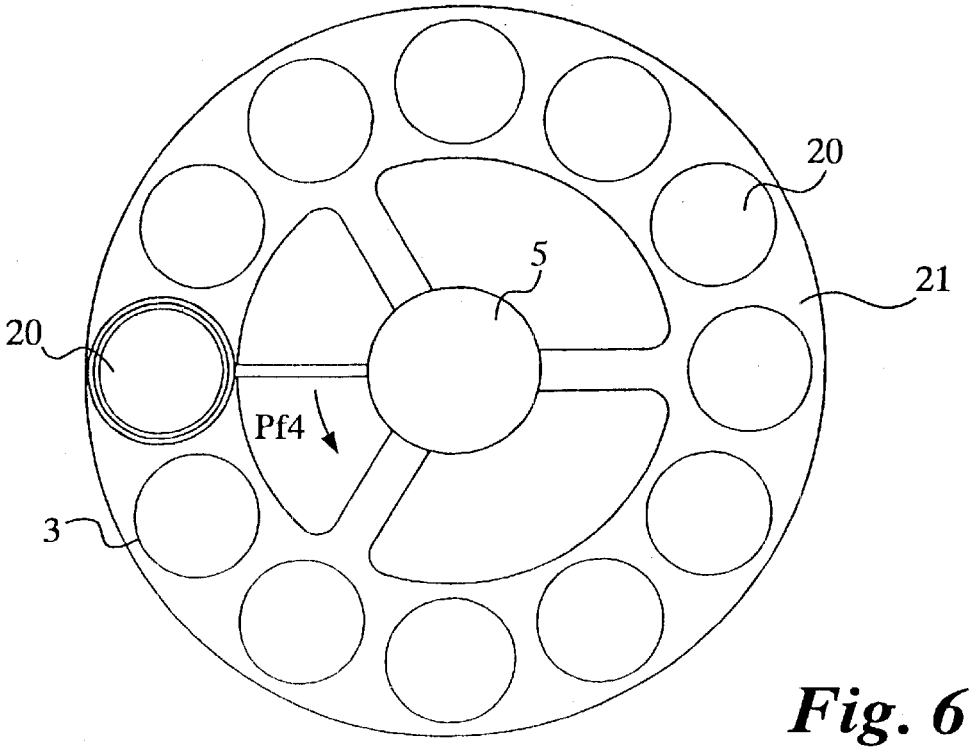
FIG. 6 shows a top view of the device shown in FIG. 5.

Another way of increasing the manufacturing capacity is showed via the system which is schematically depicted in FIGS. 5 and 6, in which brazing sites 2 with glass bells 20 are arranged and formed in a circle on a disk-shaped base plate 21. The installation is designed analogously to the installation depicted in FIGS. 3 and 4; generator 5, in this case, being arranged in the center of the base plate, and both being rotatably movable in the direction of arrow Pf4 in each case by a preprogrammed angular position of the coil and, moreover, being able to perform a lifting movement in the direction of arrow Pf5.

If the installation is designed to have several brazing sites, it is possible for the heating, cooling, and loading times of the brazing sites to be selected in such a manner that an automatic manufacturing process of the brazing sites can be executed, as a result of which a continuous and flexible manufacturing process is made possible. At least the process steps of evacuating and heating can be controlled and automated via PC and/or a programmable control system through the measurement of pressure and temperature of the brazing sites. Moreover, the charging, that is, the loading and unloading with the preassembled vacuum interrupters, including the opening and closing of the brazing sites by raising and lifting off the bells can be automated, for example, using robots. The quality of the brazed and degassed vacuum interrupters can be increased and the manufacturing cost can be reduced.

The device according to the present invention having a brazing site and having a number of brazing sites for degassing and brazing vacuum interrupters in one operation can be varied in many ways. For example, provision can be made for a central, oil-free forevacuum system in conjunction with a high or ultra-high vacuum system as the pump system. In this case, each bell of a brazing site is connected to the pump system via valves. Of course, distributed ultra-high vacuum pump systems are also possible. The unit construction system provided according to the present invention, allows the manufacturing capacity to be increased in a simple manner by providing a corresponding number of brazing sites on a base plate or several base plates including several bronzing sites, it being possible to provide a shared ultra-high vacuum pump system and, possibly, a plurality of generators with excitation coil for the individual base plates having several brazing sites.

What is claimed is:

1. A device for degassing and brazing at least one preassembled vacuum interrupter in one brazing operation, the device comprising:

a plurality of brazing sites, each brazing site including:

an opening defined by a base plate for connecting a suction pump;

a bell removably disposed on the baseplate for covering the opening; and an annular susceptor disposed inside the bell capable of receiving the at least one preassembled vacuum interrupter;

an excitation coil capable of circumscribing each bell and capable of receiving medium- or high-frequency energy, the excitation coil being movable to each of the brazing sites in succession and/or at random; and a medium- or high-frequency generator for the excitation coil.

2. The device as recited in claim 1 further comprising a grid-like locating plate or a perforated plate for receiving the at least one preassembled vacuum interrupter to be brazed, the grid-like locating plate or the perforated plate being disposed on the base plate above or in the opening.

3. The device as recited in claim 1 wherein the base plate defines an annular groove on an upper side thereof, the annular groove circumscribing the opening, and further comprising a sealing ring disposed in the annular groove and joined to the base plate in a high vacuum-tight manner.

4. The device as recited in claim 1 further comprising a high vacuum-tight gland disposed in a head region of the bell and at least one thermoelement received by the gland.

5. The device as recited in claim 1 further comprising a suction connecting piece connected in a high vacuum tight manner to the opening defined by the base plate, the suction connecting piece being connectable to the suction pump.

6. The device as recited in claim 1 further comprising a suction connecting piece connected in a high vacuum tight manner to the opening defined by the base plate, the suction connecting piece being connectable to the suction pump, and further comprising a first pressure-measuring element for an inside space of the bell and a second pressure-measuring element for the suction connecting piece.

7. The device as recited in claim 1 wherein the susceptor includes at least one of:

a soft magnetic material in a lower range of an employed frequency spectrum; and at least one of a high-melting metal and high-melting metal alloy in a higher range of the employed frequency spectrum.

8. The device as recited in claim 7 wherein the soft magnetic material includes at least one of iron and an iron alloy.

9. The device as recited in claim 7 wherein the high-melting metal includes at least one of Mo, W, and Ta and the high-melting metal alloy includes at least one of a high-grade steel and a superalloy.

10. The device as recited in claim 1 further comprising at least one insulating support disposed on the base plate, the susceptor being disposed on the at least one insulating support so as to be spaced from the base plate.

11. The device as recited in claim 1 wherein the excitation coil circumscribes the bell in an annular fashion and is disposed approximately concentrically with respect to the susceptor.

12. The device as recited in claim 1 wherein the excitation coil has a power of 1.2 kW to 30 kW at a frequency of between 3.5 kHz and 1 MHz.

13. The device as recited in claim 1 wherein the bell includes quartz glass.

14. The device as recited in claim 1 wherein the bell is movable using a lifting device.

15. The device as recited in claim 1 further comprising a suction pump connectable to the brazing sites via a suction line and a respective suction connecting piece, each suction connecting piece connected to a respective brazing site and being equipped with a high vacuum valve.

16. The device as recited in claim 1 wherein the plurality of brazing sites are disposed in two parallel rows and wherein the excitation coil and the generator are disposed between the rows on a rail so as to be capable of moving parallel to the rows and performing a vertical lifting movement.

17. The device as recited in claim 1 wherein the base plate has a disk shape and wherein the excitation coil and the generator are disposed in a center of the disk so as to be capable of rotating and performing a vertical lifting movement.

18. The device as recited in claim 1 further comprising a grid-like locating plate disposed on the base plate above or in the opening, and further comprising a brazing jig for receiving and holding the at least one preassembled vacuum interrupter, the brazing jig being insertable into the locating plate.

19. The device as recited in claim 1 further comprising a control device for automatically carrying out process steps of loading the at least one preassembled vacuum interrupter into the brazing site, and evacuating, heating, and controlling the bell as a function of temperature and pressure until a removal of the degassed and brazed at least one preassembled vacuum interrupter.

20. The device as recited in claim 19 wherein the control device includes at least one of a personal computer or a programmable control system.

* * * * *